US005640662A

United States Patent [19]

Sugimoto et al.

[11] Patent Number: 5,640,662

[45] Date of Patent: Jun. 17, 1997

[54] HOT ROLLER FOR THERMAL FIXATION DEVICE HAVING ELASTOMERIC AND ANTI-ABRASIVE COVERINGS

[75] Inventors: Katsumi Sugimoto; Keiko Tonai; Yoshihiro Tonomoto, all of Kawasaki, Japan

[73] Assignee: Fujitsu Limited, Kawasaki, Japan

[21] Appl. No.: 522,075

[22] Filed: Aug. 31, 1995

[30] Foreign Application Priority Data

Sep. 1, 1994 [JP] Japan ..... 6-208770

[51] Int. Cl.[6] ..... G03G 15/20

[52] U.S. Cl. ..... 399/333; 399/321; 492/46; 492/56

[58] Field of Search ..... 355/285, 282, 355/326 R; 219/216; 492/49, 53, 56, 46; 432/60

[56] References Cited

U.S. PATENT DOCUMENTS 4,329,565 5/1982 Namiki et al. .
5,195,228 3/1993 Fukunaga et al. ..... 492/56
5,362,593 11/1994 Inoue et al. .

FOREIGN PATENT DOCUMENTS 56-48664 5/1981 Japan .
59-185374 10/1984 Japan .
64-65589 3/1989 Japan .
4-353866 12/1992 Japan .
6-175455 6/1994 Japan .

OTHER PUBLICATIONS

*Patent Abstracts of Japan*, vol. 13, No. 43, P821, Jan. 31, 1989 for JP-A-63239479, Oct. 5, 1988.
*Patent Abstracts of Japan*, vol. 13, No. 40, P820, Jan. 30, 1989 for JP-A-63237084, Oct. 3, 1988.
*Patent Abstracts of Japan*, vol. 12, No. 180, P709, May 27, 1988 for JP-A-62291684, Dec. 18, 1987.
*Patent Abstracts of Japan*, vol. 15, No. 27, P1225 Jul. 9, 1991 for JP-A-03089379, Apr. 15, 1991.

*Primary Examiner*—R. L. Moses
*Attorney, Agent, or Firm*—Armstrong, Westerman, Hattori, McLeland & Naughton

[57] ABSTRACT

To provide a hot roller type thermal fixation device, incorporated in an electrostatic recording apparatus, particularly suitable for the thermal fixation of a multicolor toner image, said apparatus comprising a plurality of electrostatic recording units arranged in series with each other, wherein the surface smoothness of a fixed toner image is maintained at a favorable level for a long period by providing an anti-abrasive treatment onto an elastomeric covering of the heating roller. An elastomeric covering (32*b*) is applied on the surface of a heating roller (32) of a hot roller type thermal fixation device (22), and an anti-abrasive covering (32*c*) is further applied on the elastomeric covering.

14 Claims, 3 Drawing Sheets

HOT ROLLER FOR THERMAL FIXATION DEVICE HAVING ELASTOMERIC AND ANTI-ABRASIVE COVERINGS

BACKGROUND OF THE INVENTION

1. Field of the Invention

The present invention relates to a hot roller type thermal fixation device to be incorporated in an electrostatic recording apparatus, particularly to a hot roller type thermal fixation device suitable for thermally fixing a multicolor toner image.

2. Description of the Related Art

Generally speaking, in an electrostatic recording apparatus, the following processes are sequentially carried out in the recording operation; a latent-image-forming process for forming an electrostatic latent image on an electrostatic image carrier such as a photo-sensitive body or a dielectric body, a developing process for electrostatically developing the electrostatic latent image by a charged toner so that a charged toner image is obtained, a transfer process for electrostatically transferring the charged toner image onto a recording medium such as a recording paper, and a fixing process for fixing the transferred image on the recording paper. When a multicolor recording is carried out in such an electrostatic recording apparatus, the latent-image-forming process, the developing process and the transfer process are repeated at least twice. During each the repetition, a charged toner image is formed with one color toner in the developing process, which is transferred onto the same recording paper to be superimposed with a different color toner image in the transfer process. That is, at least two toner images are superimposed with each other on the recording paper to form a multicolor toner image. Thereafter, the recording paper sends to the fixing process wherein the multicolor toner image consisting of different colors is fixed onto the recording paper. As is well-known, when the full-color recording is carried out, four color toners are used; a yellow toner, a cyan toner, a magenta toner and a black toner.

As typical fixation device, a well-known hot roller type thermal fixation device, wherein the fixation of toner image onto the recording paper is carried out by thermally melting the toner image under pressure is used. Specifically, the hot roller type thermal fixation device includes a heated roller and a backup roller which is in press-contact with the heated roller, wherein the heated roller is generally constituted by a cylindrical member formed of a suitable material such as aluminum or stainless steel and a heater body disposed centrally in the cylindrical member, while, the backup roller is also formed of a metallic cylindrical member. The recording paper passes through a nip between the heated roller and the backup roller while allowing the toner image thereon to be in contact with the heated roller surface, to which the toner image is pressed and is melted to be fixed on the recording medium. In this regard, the backup roller may also have a heater body therein if necessary. Other fixation devices have been known, such as a flash type using a xenon lamp or an oven type. Different from the above-mentioned heated roller type fixation device, however, these fixation devices do not press the toner image but only melt the toner image during the fixing process.

In the case of multicolor recording, it is necessary to smooth the surface of the fixed toner image. This is because, if the surface of the fixed toner image is uneven, a diffused reflection is generated on the surface whereby a fixed toner image having a high chroma is not obtainable or the color of the fixed toner image may vary in accordance with the angle of view. Since the heated roller type thermal fixation device melts the toner image under pressure as described above, it is possible to impart a favorable smoothness to the surface of the toner image compared with the flash or oven type fixation device, whereby the heated roller type is suitable for multicolor recording. In practice, however, even if the toner image is fixed by the heated roller type fixation device described above, it is difficult to impart sufficient surface smoothness to the fixed toner image. This is particularly true of a multicolor toner image having at least two colors. Specifically, since the toner itself consists of colored particles having a diameter of about 10 μm, the surface of the recording paper becomes rough even if the toner image formed by such fine colored particles is transferred onto the recording paper and introduced into a nip between rigid surfaces of the heated roller and the backup roller. Therefore, it is impossible to impart a sufficient pressure onto the fixed toner image, which causes the surface of the fixed toner image to be unsatisfactory in smoothness, even by the above-mentioned heated roller type thermal fixation device. While the surface smoothness of the fixed toner image relies also on the manufacturing accuracy of the surfaces of the heated roller and the backup roller, the higher the accuracy of the surface smoothness, of the heated roller and the backup roller, the higher the manufacturing and/or maintenance cost.

Accordingly, to improve the surface smoothness of the fixed toner image, a heated roller type thermal fixation device has been proposed wherein an elastomeric covering such as a silicone rubber film is applied to either one or both of the heated roller and the backup roller. If the recording paper carrying the transferred toner image is introduced into a nip between the heated roller and the backup roller on which is applied the elastomeric covering, the elastomeric covering is deformed in accordance with the cross-sectional shape of the recording paper so that a sufficient pressure is applied to all the area of the recording paper. Thus, the surface smoothness of the fixed toner image is improved to a large extent. In this regard, since part of the toner image is liable to be transferred, i.e., offset-printed, onto the elastomeric covering on a heated roller with an elastomeric covering such as a silicone rubber film, an anti-offset liquid such as a silicone oil may be preferably coated on the surface of the elastomeric covering of the heated roller.

As stated above, while it is possible to improve the surface smoothness of the fixed toner image by applying the elastomeric covering onto the heated roller and the backup roller, there is another problem in that the elastomeric covering is liable to wear by abrasion. One of reasons for the abrasion of the elastomeric covering is that a front edge of the recording paper impinges onto the elastomeric covering to result in the cutting action on the latter when the recording paper is introduced into the nip between the heat roller and the backup roller. Also, the elastomeric covering may be subjected to the abrasion by a temperature sensor or a doctor blade for separating the recording paper. Particularly, the abrasion of the elastomeric covering in the fixation of a multicolor toner image is more significant than that in the fixation of a monochrome toner image. This is because the multicolor toner image is thicker than that of the monochrome toner image and therefore the pressure between the heat roller and the backup roller must be larger during the fixation of the multicolor toner image compared with that of the monochrome toner image. This causes a stepped portion in the elastomeric covering corresponding to a width of the recording paper when the recording paper passes through a nip between both the rollers, and this stepped portion is subjected to the cutting action due to the lateral edge of the recording paper. Of course, if the elastomeric covering is significantly worn, the surface smoothness of the fixed toner image is not sufficient. For example, the life of the heat roller with a silicone rubber covering is about 100,000 sheets in terms of the recording paper subjected to the fixation treatment. Particularly, in a case of a high-speed electrostatic recording apparatus wherein a large number of recording papers are treated, the hot roller type thermal fixation device thereof must be frequently replaced with a new device.

SUMMARY OF THE INVENTION

Accordingly, an object of the present invention is to provide a hot roller type thermal fixation device incorporated in an electrostatic recording apparatus wherein an anti-abrasive covering is provided on an elastomeric covering of the heat roller so that a favorable surface smoothness of a fixed toner image is maintained for a long period.

Another object of the present invention is to provide a hot roller type thermal fixation device wherein the anti-abrasive covering on the elastomeric covering of the heated roller has an improved wettability to an anti-offset liquid.

The hot roller type thermal fixation device according to the present invention is characterized in that a heated roller has an elastomeric covering on which an anti-abrasive covering is provided, and is particularly suitable for fixing a multicolor toner image. The hot roller type thermal fixation device according to the present invention may have means for coating an anti-offset liquid on the heated roller to prevent the offset of a toner image, onto the heated roller, from occurring. According to the present invention, preferably the elastomeric covering is formed of a silicone rubber film and the anti-abrasive covering is formed of a fluorine type resin. In this case, the silicone rubber film has a thickness in a range from about 500 μm to about 5 mm, and a JIS-A hardness in a range from about 10° to about 60°. The fluorine type resin film suitably has a thickness in a range from about 10 to about 100 μm, and preferably in a range from about 30 to about 50 μm. If the fluorine type resin film is used as the anti-abrasive covering, the anti-offset liquid coated on the heated roller by the coating means is comprised of a silicone oil and a fluorine type surfactant in a range from about 5 to about 20% by weight. Preferably, an electro-conductive fine powder such as a carbon fine powder is mixed with the anti-abrasive covering, preferably in a range from about 3 to about 20% by weight. Further, a toner of the toner image to be fixed preferably has a shelf elastic modulus in a range from about $1\times10^2$ to about $1\times10^4$ dyne/cm$^2$ and a loss elastic modulus in a range from about $1\times10^2$ to about $2\times10^4$ dyne/cm$^2$ .

As is apparent from the above description, in the heated roller type thermal fixation device according to the present invention, the abrasive wear of the elastomeric covering can be prevented by providing the anti-abrasive covering on the elastomeric covering applied on the heated roller. If the elastomeric covering is a silicone rubber film and the anti-abrasive covering is a fluorine type resin film, the anti-offset liquid coated on the heated roller by the coating means is comprised of a silicone oil and a fluorine type surfactant, whereby the wettability of the heated roller to the silicone oil can be improved.

BRIEF DESCRIPTION OF THE DRAWINGS

These and other objects of the present invention will become apparent from the following detailed description of the preferred embodiment of the invention, taken in connection with the accompanying drawings.

In the drawings.

DESCRIPTION OF THE PREFERRED EMBODIMENTS

An embodiment of the hot roller type thermal fixation device according to the present invention will be described with reference to the attached drawings.

Figure 1:
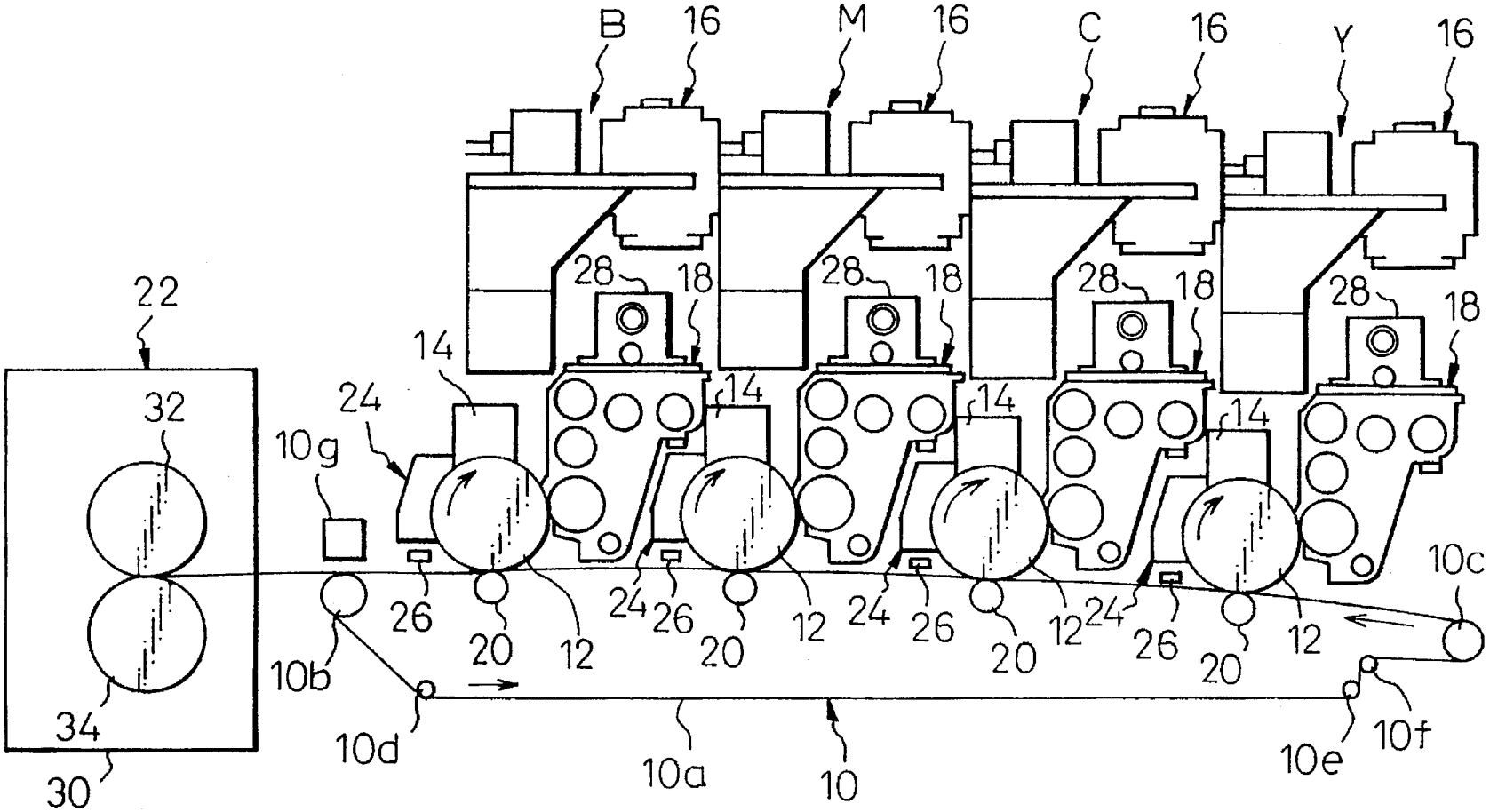
FIG. 1 is a schematic view of a multicolor electrostatic recording apparatus incorporating hot roller type thermal fixation devices according to the present invention.

FIG. 1 schematically illustrates a high-speed full color laser printer as a typical multicolor electrostatic recording apparatus wherein a hot roller type thermal fixation device according to the present invention is incorporated. The high-speed laser printer has an endless-belt conveyor 10, for conveying a recording medium such as a recording paper, which includes an endless belt 10*a* formed, for example, of a flexible dielectric material such as a suitable synthetic resin material. The endless belt 10*a* is wrapped around four rollers 10*b*, 10*c*, 10*d* and 10*e*. The roller 10*b* functions as a driving roller driven to rotate by a suitable drive mechanism, not shown, in the arrowed direction. The roller 10*c* functions as a driven roller and also as a charging roller for imparting an electric charge to the endless belt 10*a*. The rollers 10*d* and 10*e* function as guide rollers and are arranged closer to the driving roller 10*b* and the driven roller 10*c*, respectively. A tension roller 10*f* is provided between the driven roller 10*c* and the guide roller 10*e* to impart suitable tension to the endless belt 10*a*. An upper run of the endless belt 10*a*, i.e., the run between the driving roller 10*b* and the driven roller 10*c* forms a moving path for the recording paper, and the recording paper is introduced into this paper moving path and discharged therefrom at the driving roller 10*b*. When the recording paper is introduced into the paper moving path from the driven roller 10*c*, the recording paper is attracted to the endless belt 10*a* due to the electric charge thereof, whereby the positional shift of the recording paper relative to the endless belt 10*a* is avoided. An AC discharger 10*g* is provided in the vicinity of the driving roller 10*b* for discharging the electric charge from the endless belt 10*a*, whereby the recording paper is easily released from the endless belt 10*a*.

The high-speed laser printer has four electrostatic recording units Y, C, M and B which are arranged in series with each other along the upper run of the endless belt 10*a* from upstream to downstream. The electrostatic recording units Y, C, M and B have the same structure, and the only difference between them is that they record a yellow toner image, a cyan toner image, a magenta toner image and a black toner image on the recording paper moving along the upper run of the endless belt 10*a*. Each electrostatic recording unit is provided with a photo-sensitive drum 12 driven to rotate in the arrowed direction during the recording operation. Above the photo-sensitive drum 12 is arranged a precharger 14 such as a corona charger or a scorotron charger, whereby the rotating surface of the photo-sensitive drum 12 is sequentially and uniformly charged by an electric charge. An electrostatic latent image is recorded on the charged area of the photo-sensitive drum 12 by an optical writing means such as a laser beam scanner 16.

The electrostatic latent image recorded on the photo-sensitive drum 12 is developed as a charged toner image with a predetermined color toner by a developer 18 disposed above the paper moving path. The charged toner image is electrostatically transferred to the recording paper by an electro-conductive transfer roller 20 disposed beneath the photo-sensitive drum 12. As shown in FIG. 1, the electro-conductive transfer roller 20 is brought into contact with the photo-sensitive drum 12 via the upper run of the endless belt 10*a* and imparts an electric charge having a polarity reverse to that of the charged toner image to the recording paper conveyed by the endless belt 10*a*, whereby the charged toner image is electrostatically transferred from the photo-sensitive drum 20 to the recording paper.

According to the structure as stated above, when the recording paper introduced from the driven roller 10*c* of the endless-belt conveyor 10 has sequentially passed through the electrostatic recording units Y, C, M and B, toner images of four colors are superimposed on each other on the recording paper to form a full color image, then the recording paper is sent from the driving roller 10*b* of the endless-belt conveyor 10 to the hot roller type thermal fixation device 22 wherein the full color image is thermally fixed onto the recording paper. The hot roller type thermal fixation device 22 is structured in accordance with the present invention as described later in more detail.

In the respective electrostatic recording unit Y, C, M or B, a residual toner which has not been transferred to the recording paper is left on the surface of the photo-sensitive drum 12, which is removed by a cleaner 24. In FIG. 1, reference numeral 26 denotes a decharging light emitting body such as an LED array, and 28 denotes a developing agent supplementation container for properly supplementing a toner component in the developer 18.

Figure 2:
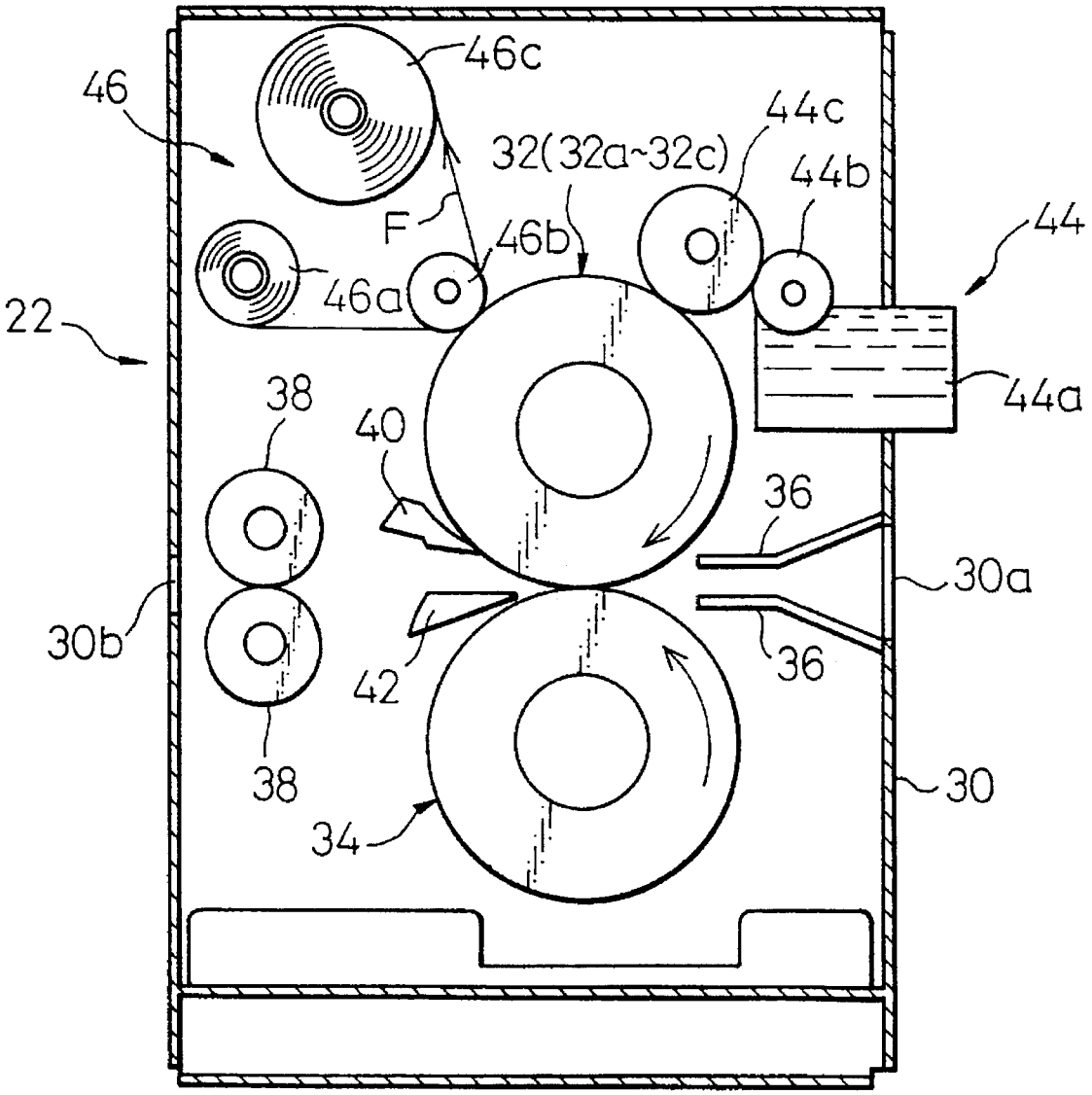
FIG. 2 is an enlarged schematic view of the hot roller type thermal fixation device shown in FIG. 1.
Figure 3:
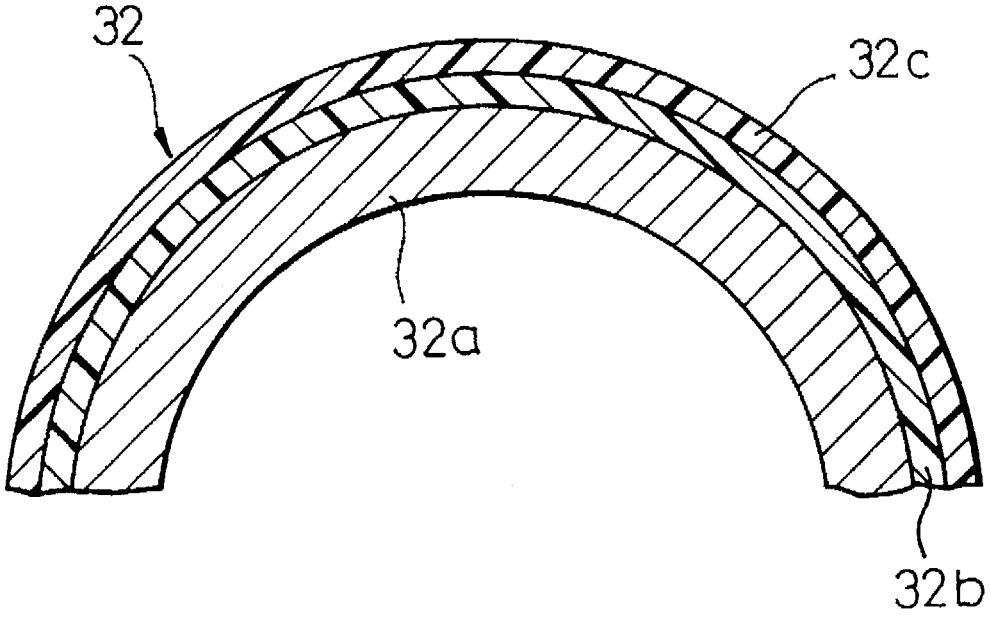
FIG. 3 is a cross-sectional view of part of a heat roller used in the hot roller type thermal fixation device.

FIG. 2 illustrates an enlargement of the hot roller type thermal fixation device 22 shown in FIG. 1, wherein the hot roller type thermal fixation device 22 has a housing 30 in which a heated roller 32 and a backup roller 34 are rotatably provided. As specifically illustrated in FIG. 3, the heated roller 32 consists of a cylindrical member 32*a* formed of a metallic material such as aluminum or stainless steel, and a heater body (not shown) disposed along a central axis of the cylindrical member 32*a*, such as a halogen lamp or a infrared ray lamp. On the circumference of the cylindrical member 32*a* of the heated roller 32 is applied a covering 32*b* of an elastomer such as silicone rubber which is further covered with an anti-abrasive covering 32*c* such as a fluorine type resin. The backup roller 34 also consists of a cylindrical member of a metallic material, on the circumference of which may be applied an elastomeric covering and an anti-abrasive covering similar to those on the heated roller 32. If necessary, a heater body may be provided in the backup roller 34.

When the hot roller type thermal fixation device 22 is operated, the heated roller 32 and the backup roller 34 are driven to rotate in the arrowed direction shown in FIG. 2 so that the recording paper discharged from the driving roller 10*b* of the endless-belt conveyor 10 is introduced into a nip between both the rollers 32, 34 through an entrance 30*a* of the housing 30. In this regard, a pair of upper and lower guide plates 36 extend from the inner wall of the entrance 30*a* toward the nip between both the rollers 32, 34 so that the recording paper is guided into the nip. When the recording paper passes through the nip between both the rollers 32, 34, the transferred toner image is pressed and molten by heat whereby the transferred toner image is thermally fixed onto the recording paper. Then, the recording paper is discharged outside from an exit 30*b* of the housing 30 by a pair of recording paper conveyor rollers 38. When the recording roller passes through the nip between both the rollers 32, 34, a leading end of the recording paper may wrap around the heated roller 32 or the backup roller 34 while sticking thereto. To prevent such a wrapping of recording paper, doctor blades 40, 42 are provided for releasing the recording paper.

Means 44 is provided in the hot roller type thermal fixation device 22, for coating an anti-offset liquid onto the anti-abrasive covering 32*c* of the heat roller 32. The means 44 consists of a tank 44*a* for containing an anti-offset liquid, a pickup roller 44*b* for picking up the anti-offset liquid in the tank 44*a*, and coating roller 44*c* for coating the anti-offset liquid picked up by the pickup roller 44*b* onto the anti-abrasive covering 32*c* of the heated roller 32. By coating the anti-offset liquid on the heated roller 32, it is possible, during the fixation of the toner image, to prevent part of the toner image from being offset onto the anti-abrasive covering 32*c* of the heated roller 32. While the anti-offset liquid coated onto the anti-abrasive covering 32*c* of the heated roller 32 is contaminated by contact with the toner image, the contaminated anti-offset liquid is sequentially wiped off from the anti-abrasive covering 32*c* by a cleaner means 46. The cleaner means 46 consists of a roll 46*a* formed by winding a fleece F in a roll shape, a pressure roller 46*b* for pressing the fleece F delivered from the roll 46*a* onto the heated roller 32, and a takeup roller for winding the fleece F passing through the pressure roller 46*b*. In this regard, the fleece F is a thin felt-like cloth for wiping the contaminated anti-offset liquid from the anti-abrasive covering 32*c*.

According to the hot roller type thermal fixation device 22 adapted as above, it is possible to impart a sufficient smoothness to the fixed toner image surface by the elastomeric covering 32*b* of the heated roller 32, while preventing the elastomeric covering 32*b* from wearing by the provision of the anti-abrasive coating 32*c* thereon, resulting in the prolongation of life-span of the heat roller 32.

In the hot roller type thermal fixation device according to the present invention, the elastomeric covering of the heated roller 32 such as a silicone rubber film has a thickness in a range from about 500 μm to about 5 mm, and a JIS A hardness in a range from about 10° to about 60°. If the JIS A hardness of the elastomeric covering 32*c* exceeds 60°, the rigidity of the heated roller 32 increases too much to impart a sufficient smoothness to the fixed toner image surface. On the other hand, the thickness of the anti-abrasive covering 32*c* is in a range from about 10 to about 100 μm, preferably from about 30 to 50 μm. When fluorine type resin is used as the anti-abrasive covering, the life-span thereof can be prolonged to about 100,000 to 600,000 sheets in terms of the recording paper subjected to the fixation treatment. In this regard, as the fluorine type resin, perfluoroalkoxy resin (PFA) may be preferably used.

As the anti-offset liquid, silicone oil is generally used. However, when the fluorine type resin is used as the anti-abrasive covering, the silicone oil has a poor wettability to the fluorine type resin covering 32*c* and thus is adhered onto the surface thereof in a drop form. Such a drop of silicone oil is locally absorbed in the recording paper and exhibits a stain thereon. Such a problem can be solved by improving the wettability of silicone oil to the fluorine type resin covering. As is well-known, the wettability of silicone oil to the fluorine type resin covering is evaluated by the measurement of contact angle with the fluorine type resin covering of a silicone oil drop adhered thereon. That is, the larger the contact angle of silicone oil drop (i.e., the higher the silicone oil drop), the poorer the wettability thereof. Contrarily, the smaller the contact angle of silicone oil drop (i.e., the lower the silicone oil drop), the better the wettability thereof.

It is possible to improve the wettability of silicone oil to the fluorine type resin covering 32*c* by adding a fluorine type surfactant to the silicone oil. Examples of such a fluorine type surfactant are X-70-108B, X-70-108D and X-70-108E available from Shin-etsu Kagaku Kogyo K.K. To improve the wettability, three kinds of improved silicone oils were prepared by adding X-70-108B of 5% by weight, 10% by weight and 20% by weight to the original silicone oil, on which the contact angle was then measured. The results are as follows:

(1) the contact angle is 15° when X-70-108B of 5% by weight is added;

(2) the contact angle is 7° when X-70-108B of 10% by weight is added; and (3) the contact angle is 5° when X-70-108B of 20% by weight is added.

As a comparative example, a contact angle when no X-70-108B is added was measured, which value is about 35°. Accordingly, it is apparent that the contact angle is greatly reduced by the addition of fluorine type surfactant. In this regard, the amount of improved silicone oil to be coated is in a range from about 0.5 to about 10 mg per surface area defined by 210 mm×297 mm (corresponding to A4 size recording paper).

Preferably, an electro-conductive fine powder is properly mixed, as an antistatic agent with the fluorine type resin forming the covering 32*c* of the heated roller 32. This is because, if the fluorine type resin covering of the heated roller 32 (also of the backup roller 34) is charged during the operation of the hot roller type thermal fixation device, the recording paper may be electrostatically attracted to the covering and wrapped around the same. As the electro-conductive fine powder, carbon is particularly favorable, because it was found from the test results that the fluorine type resin covering 32*c* can have not only a better anti-static effect but also an increased hardness durable against the abrasion if a carbon fine powder is mixed with the fluorine type resin covering 32*c*. Also, it was found from the test results that the wettability of the fluorine type resin covering to the silicone oil is unexpectedly improved by mixing the carbon fine powder with the fluorine type resin covering 32*c*. Further, due to the improvement of wettability, the anti-offset effect is more enhanced, resulting in a high quality fixed toner image superior to that initially expected. The amount of carbon fine powder to be mixed is preferably in a range from about 3 to about 20% by weight. If the amount of carbon fine powder is less than 3% by weight, it is impossible to obtain a sufficient anti-static effect and an improvement in the resistance to abrasion of the fluorine type resin covering 32*c*. Contrarily, if the amount of carbon fine powder exceeds 20% by weight, the hardness of the fluorine type resin covering 32*c* increases to deteriorate the quality of the fixed toner image. In this regard, the carbon fine powder was mixed with the fluorine type resin covering of 10% by weight in the above experiment.

Since the amount of toner to be fixed is larger in a multicolor recording than in a monochrome recording, a toner having a lower melting point is usually used in the multicolor recording for the purpose of reducing the energy necessary for the fixation. In this case, if the elasticity of the elastomeric covering 32*b* of the heat roller 32 becomes poor by the application of the fluorine type resin covering 32*c*, the problem of offset of the toner image at a high temperature may arise. It was found that a viscoelasticity of molten toner is particularly related to this offset problem. For example, it is possible to solve the offset problem of the toner image at a high temperature by adopting a toner having a storage elastic modulus at 150° C. in a range from about $1\times10^2$ to about $1\times10^4$ dyne/cm$^2$ and a loss elastic modulus in a range from about $1\times10^2$ to about $2\times10^4$ dyne/cm$^2$.

The hot roller type thermal fixation device according to the present invention is favorably used together with a multicolor electrostatic recording apparatus, but it should be noted that it is usable for a monochrome electrostatic recording apparatus.

As apparent from the above description, it is possible not only to largely prolong the life-span of a hot roller type thermal fixation device according to the present invention, by applying an anti-abrasive covering onto an elastomeric covering of a heated roller thereof, but also to solve the offset problem of a toner image inherent to the application of the anti-abrasive covering.

It is to be understood that the invention is by no means limited to the specific embodiments illustrated and described therein, and that various modifications thereof may be made which come within the scope of the present invention as defined in the appended claims.

We claim:

1. A hot roller type thermal fixation device which comprises a heating roller (32) having an elastomeric covering (32*b*) on which an anti-abrasive covering (32*c*) is provided, wherein the elastomeric covering (32*b*) is formed of a silicone rubber material, and the anti-abrasive covering (32*c*) is formed of a fluoroplastic material and includes an electroconductive fine powder.

2. The thermal fixation device according to claim 1, wherein it is used for fixing a multicolor toner image.

3. The thermal fixation device according to claim 1, wherein means (44) for applying an anti-offset liquid to the heating roller (32) is provided to prevent offsetting of a toner image on the heating roller (32).

4. The thermal fixation device according to claim 1, wherein the fluoroplastic has a thickness in a range from around 10 μm to around 100 μm.

5. The thermal fixation device according to claim 4, wherein the thickness is preferably in a range from around 30 μm to around 50 μm.

6. The thermal fixation device according to claim 3, wherein the anti-offset liquid is comprised of a silicon oil and of a fluorine type surfactant in a range from around 5 to around 20% by weight.

7. The thermal fixation device according to claim 1, wherein the electro-conductive fine powder is a carbon fine powder.

8. The thermal fixation device according to claim 7, wherein the amount of the carbon fine powder is in a range from around 3 to around 20% by weight.

9. The thermal fixation device according to claim 1, wherein a toner of the toner image to be fixed has a shelf elastic modulus in a range from around $1\times10^2$ to around $2\times10^4$ dyne/cm$^2$ and has a loss elastic modulus in a range from around $1\times10^2$ to around $2\times10^4$ dyne/cm$^2$.

10. The thermal fixation device of claim 1, wherein the heating roller comprises a cylindrical member formed of a metallic material and the elastomeric covering (32*b*) is provided on said metallic material.

11. A hot roller type thermal fixation device which comprises a heating roller (32) having an elastomeric covering (32*b*) on which an anti-abrasive coveting (32*c*) is provided, the anti-abrasive covering (32*c*) including an electro-conductive fine powder, wherein the elastomeric covering (32*b*) is formed of a silicone rubber material, and the anti-abrasive covering (32*c*) is formed of a fluoroplastic material.

12. The thermal fixation device of claim 11, wherein the heating roller comprises a cylindrical member formed of a metallic material and the elastomeric covering (32*b*) is provided on said metallic material.

13. A hot roller type thermal fixation device which comprises a heating roller (32) having an elastomeric coveting (32*b*) on which an anti-abrasive covering (32*c*) is provided, wherein the elastomeric coveting (32*b*) is formed of a silicone rubber material, and the anti-abrasive coveting (32*c*) is formed of a fluoroplastic material and the silicone rubber has a thickness in a range from around 500 μm to around 5 mm.

14. A hot roller type thermal fixation device which comprises a heating roller (32) having an elastomeric covering (32*b*) on which an anti-abrasive covering (32*c*) is provided, wherein the elastomeric coveting (32*b*) is formed of a silicone rubber material, and the anti-abrasive coveting (32*c*) is formed of a fluoroplastic material and the silicone rubber has a Shore A hardness in a range from around 10° to around 60°.

* * * * *